US006994194B2

(12) United States Patent
Smith

(10) Patent No.: US 6,994,194 B2
(45) Date of Patent: Feb. 7, 2006

(54) FLIGHT BAG APPARATUS AND METHOD

(75) Inventor: J. Bryce Smith, Clearfield, UT (US)

(73) Assignee: Eastern Shores, Inc., Kaysville, UT (US)

( * ) Notice: Subject to any disclaimer, the term of this patent is extended or adjusted under 35 U.S.C. 154(b) by 85 days.

(21) Appl. No.: 10/687,160

(22) Filed: Oct. 16, 2003

(65) Prior Publication Data

US 2005/0082132 A1 Apr. 21, 2005

(51) Int. Cl.

| | |
|---|---|
| ***A45C 3/00*** | (2006.01) |
| ***A45C 11/36*** | (2006.01) |
| ***A47B 3/10*** | (2006.01) |
| ***A45F 3/00*** | (2006.01) |

(52) U.S. Cl. ..... 190/111; 190/11; 190/110; 40/904; 206/425

(58) Field of Classification Search ..... 190/109–111, 190/11; 206/425; 40/904; 383/106
See application file for complete search history.

(56) References Cited

U.S. PATENT DOCUMENTS

| | | | | | |
|---|---|---|---|---|---|
| 1,430,207 | A | * | 9/1922 | Woodhouse | 40/651 |
| 1,491,807 | A | * | 4/1924 | McLinn | 190/11 |
| 2,011,879 | A | | 8/1935 | Stein | 150/1.6 |
| 2,103,281 | A | | 12/1937 | Stanley | 150/1.6 |
| 2,294,276 | A | * | 8/1942 | Callinicos | 283/34 |
| 2,299,673 | A | * | 10/1942 | Zolkind | 312/231 |
| 2,316,328 | A | | 4/1943 | Guenther et al. | 150/1.6 |
| 2,333,523 | A | * | 11/1943 | Cohun | 281/16 |
| 2,502,275 | A | * | 3/1950 | Perlin | 402/70 |
| 2,612,199 | A | | 9/1952 | Shockett | |
| 2,869,604 | A | * | 1/1959 | Fitzsimmons | 383/38 |
| 3,232,685 | A | * | 2/1966 | Wilstein et al. | 108/23 |
| 3,335,375 | A | | 8/1967 | Fujita | |
| 3,454,068 | A | | 7/1969 | Goldstein et al. | 150/1.6 |
| 3,791,314 | A | * | 2/1974 | Berretta | 108/43 |
| 3,904,003 | A | | 9/1975 | Margerum | 190/11 |
| 4,103,809 | A | * | 8/1978 | Frost et al. | 224/222 |
| 4,444,418 | A | * | 4/1984 | Goldstein | 281/45 |
| 4,515,493 | A | * | 5/1985 | Radovich | 402/4 |
| 4,673,197 | A | * | 6/1987 | Shtipelman et al. | 283/34 |
| 4,793,508 | A | * | 12/1988 | Thompson | 220/533 |
| 4,852,293 | A | * | 8/1989 | Levine et al. | 43/54.1 |
| 4,998,185 | A | * | 3/1991 | DeNigris, Jr. | 362/98 |
| 5,114,009 | A | * | 5/1992 | Johnston | 206/425 |
| 5,160,001 | A | | 11/1992 | Marceau | 190/102 |

(Continued)

FOREIGN PATENT DOCUMENTS

DE 10213303 A1 * 10/2003

(Continued)

*Primary Examiner*—Sue A. Weaver
(74) *Attorney, Agent, or Firm*—Holland & Hart

(57) ABSTRACT

A carrying case for storing and transporting various items. The carrying case is especially useful as a flight bag. The carrying case includes an organizing flap hinged to the carrying case, and one or more organizing pockets or internal flaps that are hinged to the organizing flap. The organizing pockets can thus be opened and rotated like pages of a book for convenient storage of particular items or papers. The organizing pockets may be sized to hold Sectional Aeronautical Charts published by the Federal Aviation Administration for use by aircraft pilots. The rotatable organizing pockets are easily accessible to pilots to allow a pilot to direct more of his or her attention to piloting an aircraft and less time fumbling through files or pockets to locate maps and papers.

42 Claims, 7 Drawing Sheets

U.S. PATENT DOCUMENTS

| | | | | | |
|---|---|---|---|---|---|
| 5,207,303 | A | * | 5/1993 | Oswalt et al. | 190/108 |
| 5,217,119 | A | | 6/1993 | Hollingsworth | 206/583 |
| 5,350,045 | A | * | 9/1994 | Robertson | 190/110 |
| 5,423,404 | A | * | 6/1995 | Shaw | 190/102 |
| 5,732,978 | A | * | 3/1998 | Tunnell, IV | 283/34 |
| 5,749,447 | A | * | 5/1998 | Hersh et al. | 190/112 |
| 5,806,677 | A | * | 9/1998 | Storti | 206/425 |
| 5,881,850 | A | | 3/1999 | Murdoch | 190/110 |
| 5,954,170 | A | | 9/1999 | Chisholm | 190/109 |
| 6,047,752 | A | | 4/2000 | Southwick | 150/117 |
| 6,164,451 | A | * | 12/2000 | Sherman | 206/581 |
| 6,213,670 | B1 | * | 4/2001 | Wien | 402/73 |
| 6,244,400 | B1 | | 6/2001 | Bowers | 190/110 |
| 6,491,074 | B1 | | 12/2002 | Roegner | 150/112 |
| 6,516,927 | B2 | | 2/2003 | Krulik | 190/114 |

FOREIGN PATENT DOCUMENTS

| | | | |
|---|---|---|---|
| WO | WO 92/01403 | * | 2/1992 |

* cited by examiner

FLIGHT BAG APPARATUS AND METHOD

FIELD OF THE INVENTION

The present invention relates to bags, carrying cases, and luggage, and more particularly to a bag that is especially useful as a flight bag.

BACKGROUND OF THE INVENTION

Carrying cases for holding various papers, files, maps, clothes, computers, sports equipment, and other objects are often sized to accommodate a large number of different items. Such cases or bags are often used by travelers, commuters, businesspeople, students, and others to conveniently transport various items from one place to another. Many carrying bags have been customized over the years to hold certain sized objects and papers, such as the common expandable briefcase, which is sized to accommodate a number of files.

However, some members of the population continue to find it difficult to use currently available bags for certain applications. For example, aircraft pilots typically carry with them items including maps, writing instruments, flashlights, batteries, hand-held electronics (such as radios), and other items in bags that are generally not customized to their particular needs. While there have been a number of bags manufactured with pockets to hold some standard size papers, files, and pencils, the maps used by aircraft pilots are generally just filed into an oversized pocket within the bag.

Aircraft pilots generally need to have their maps, particularly their Sectional Aeronautical Charts maps from by the U.S. Department of Transportation's Federal Aviation Administration (FAA), readily available during flight. Pilots may also need Terminal Area Charts and/or World Aeronautical Charts readily available. Often pilots will traverse large geographic regions that encompass multiple aeronautical sections in a single flight, requiring access to multiple maps. As a result, pilots may need to access certain of their maps several times during a flight. However, it is difficult to rifle through the typical carrying bags to find the desired map while also providing adequate attention to the task of piloting the aircraft. Furthermore, during some flights where the pilot is required to rely solely on his instruments to guide the aircraft, it may be even more important for the pilot quickly find and access the correct maps with a minimum of attention diverted from the airplane's instruments. If the pilot has trouble locating his maps and diverts attention from his instruments and his flying duties for an extended period while fumbling around for his maps, a sudden change in direction or other sudden movement, a drop in elevation, or just a lack of concentration can quickly disorient a pilot. Current carrying bags do not provide a quick and convenient way for pilots to organize and find their maps and other items. Therefore, there is a need for a flight bag capable of organizing maps and other items for quick and easy reference that minimizes the diversion of a pilot from his flying duties.

SUMMARY OF THE INVENTION

The present invention provides a piece of luggage or carrying case for storing and transporting various items. The carrying case is especially useful as a flight bag. The carrying case includes an organizing flap hinged to the carrying case, and one or more organizing pockets or internal flaps that are hinged to the organizing flap. However, the organizing pockets are hinged a distance away from the hinge of the organizing flap. The organizing pockets can thus be opened and rotated like pages of a book for convenient storage and easy access to particular items or papers. The organizing pockets are sized according to some embodiments to hold Sectional Aeronautical Charts, Terminal Area Charts, and/or World Aeronautical Charts. The pockets may leave a title block of the maps exposed for the convenience of pilots or other users. The rotatable organizing pockets are easily accessible to pilots to allow a pilot to direct more of his or her attention to piloting an aircraft and less time fumbling through files or pockets to locate maps and papers. The rotatable organizing pockets enhance pre-flight planning and allow the pilot to organize maps according to the expected order of use.

According to some embodiments, the organizing pockets of the carrying case are individually or collectively removable from the flight bag. Accordingly, the organizing pockets may be attached by releasable fasteners which may include rings, channels, hook and loop tape, or other components.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

Throughout the drawings, identical reference numbers and descriptions indicate similar, but not necessarily identical elements.

DETAILED DESCRIPTION OF THE INVENTION

Luggage items such as carrying cases and flight bags are not uncommon. Nevertheless, there are many inconveniences associated with the pieces of luggage currently available. The typical pockets and accessories are often difficult to use to organize items and papers in an easily retrievable manner. Therefore, the present specification describes a carrying case with new convenient features. The specification describes internally hinged pockets or flaps that facilitate convenient storage and retrieval. The internally hinged pockets or flaps are configured in a manner similar to pages of a book according to some embodiments, so that a user can easily flip through "pages" of stored items to find the one needed. The internally hinged pockets may be particularly useful for flight bags, however, the principles described herein are not so limited. The principles described herein may be applied to any luggage item.

As used throughout the specification and claims, the term "plate" is used broadly to mean any item, the thickness of which is small or shallow in comparison with the other dimensions of the item. A "flap" is a projecting or hanging piece, usually, but not always, attached to an item at only one side. As used herein, a "flap" may also be closed or integrated with the item it hangs from. A "shell" is an external protective case or cover. A "shell" may be hard and rigid or soft and pliable. The words "including" and "having," as used in the specification, including the claims, shall have the same meaning as the word "comprising."

Figure 1:
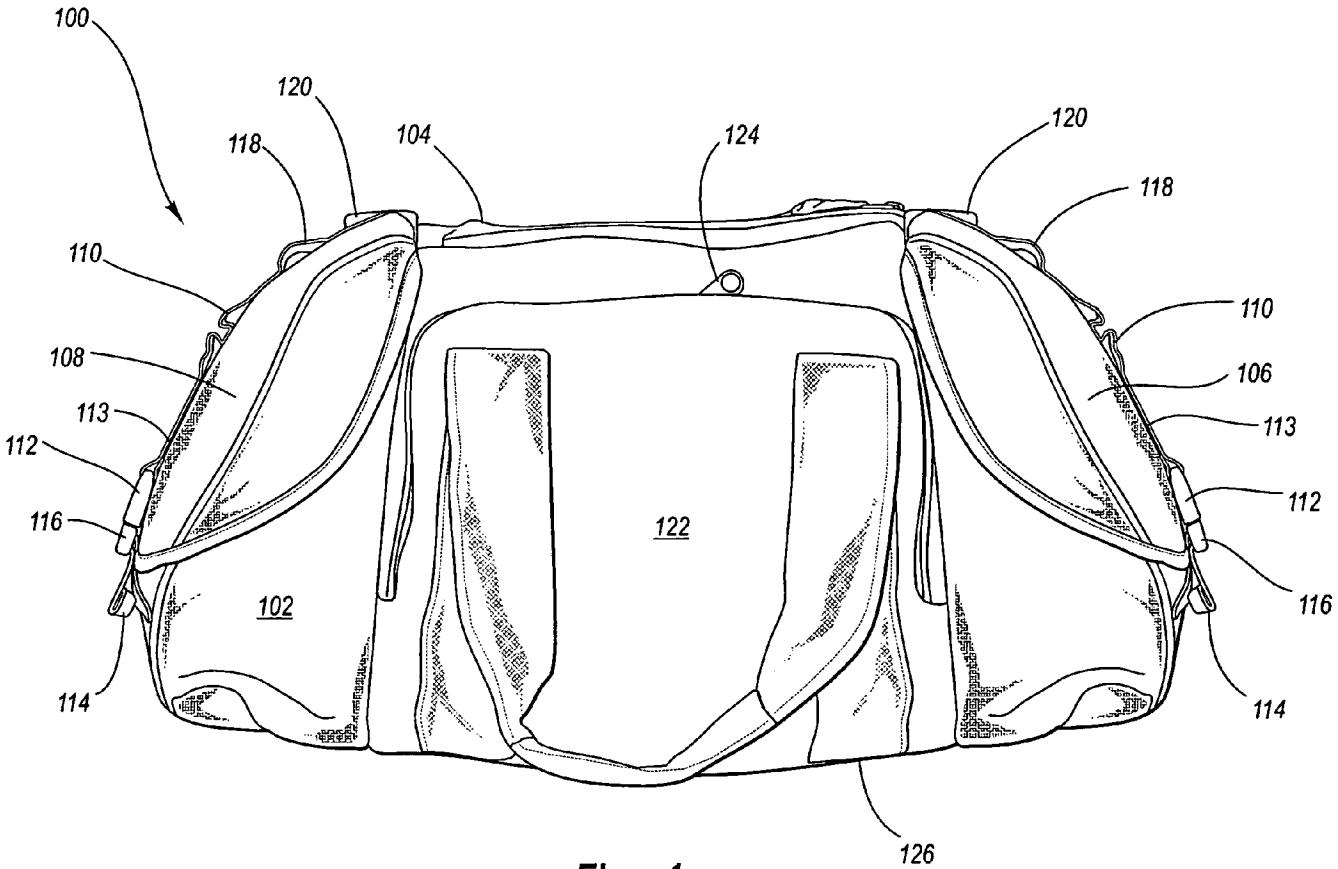
FIG. 1 is a perspective view of a carrying case with a closed side flap according to one embodiment of the present invention.
Figure 2:
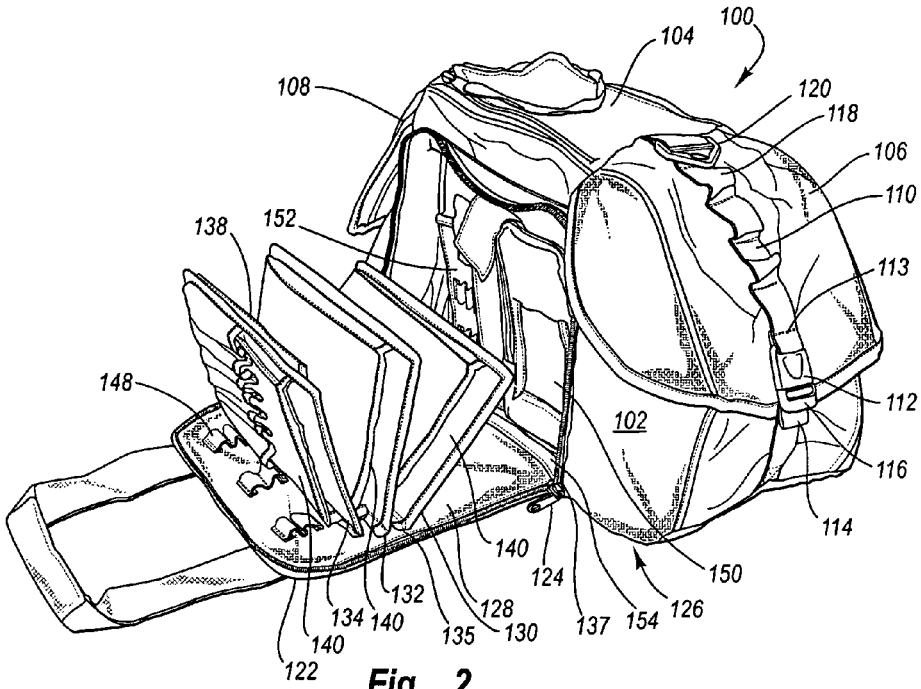
FIG. 2 is a side perspective view of the carrying case of FIG. 1 with the flap open according to one embodiment of the present invention.
Figure 3:
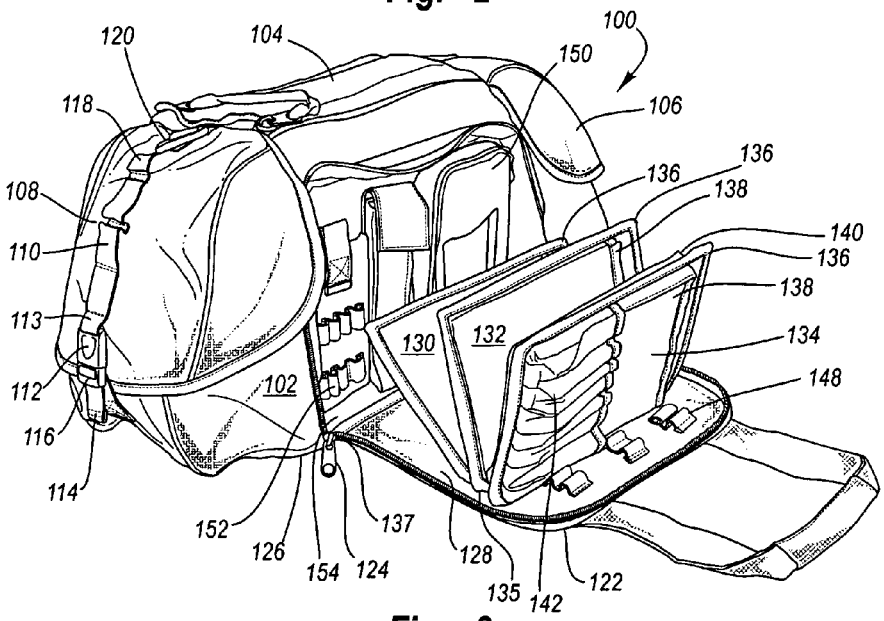
FIG. 3 is an opposite perspective view of the carrying case of FIG. 2 according to one embodiment of the present invention.

Turning now to the figures, and in particular to FIGS. 1–3, a piece of luggage or carrying case is shown according to principles of the present invention. According to FIGS. 1–3, the carrying case is a flight bag 100. The flight bag 100 includes an outer shell 102 which may be soft or hard. However, the embodiment shown in FIGS. 1–3 illustrates a soft outer shell 102. The outer shell 102 may be made of polyester, rayon, cotton, plastic, or other fabrics and materials. The outer shell 102 defines an inner space that may be used to store any number of items.

The flight bag 100 includes one or more pockets, for example a central pocket 104 and first and second side pockets 106, 108. The first and second side pockets 106, 108 may each be sized, for example, to enclose a headset. Each of the first and second side pockets 106, 108 includes a first strap 110 at least partially sewn to the outer shell 102 with a first fastener 112 attached toward a first end 113 thereof. A second strap 114 is also attached to the outer shell 102 adjacent to the first straps 110 at each of the first and second side pockets 106, 108. A second fastener 116 is attached to an end of the second strap 114 and shaped to snappingly mate and lock with the first fastener 112. A second end 118 of each of the first straps 110 is attached an anchor 120. The anchor 120 may include a hole receptive an end of a carrying strap or other device.

The flight bag 100 also includes an organizing flap 122. According to FIG. 1, the organizing flap 122 is closed by a zipper 124, and an external surface of the organizing flap 122 may thus form a portion of the outer shell 102. However, the organizing flap 122 is hinged to the flight bag 100 in order to facilitate opening the flap 122 as shown in FIGS. 2–3. According to FIGS. 2–3, the organizing flap 122 is hinged at a base 126 of the flight bag 100. Therefore, the organizing flap 122 may lay open and, depending on the surface the flight bag is set upon, be arranged substantially coplanar with the base 126.

The organizing flap 122 includes an interior surface 128 (FIGS. 2–3) to which one or more interior organizer pockets or flaps 130 (FIGS. 2–3) are hinged. According to the embodiment of FIGS. 2–3, there are three interior organizer pockets or flaps 130, 132, 134, but fewer or greater numbers of pockets may also be used. Each of the interior organizer pockets 130, 132, 134 comprises a stiff center plate 136 (FIG. 3) that is made, for example, of plastic and may be covered with fabric. The stiff center plate 136 is shown as a generally flat, rectangular member. The stiff center plate 136 has first and second open pockets 138, 140 on opposite sides thereof according to the embodiment of FIGS. 2–3. However, according so some embodiments there may only be a first or a second pocket 138, 140. The first and second pockets 138, 140 are made of fabric and are therefore generally flexible. One or more of the interior organizer pockets 130, 132, 134 may include additional pockets 142 (FIG. 3) for holding items such as flashlights, pens, pencils, or other utensils.

The interior organizer pockets 130, 132, 134 are each rotatable about a hinge-attachment 135 to the interior surface 128 of the organizing flap 122. Further, the interior organizer pockets 130, 132, 134 are only connected to the flight bag 100 at the interior surface 128. The hinge-attachment of the interior organizer pockets 130, 132, 134 is also spaced from a hinge 137 of the organizer flap 122 to the base 126. Therefore, the interior organizer pockets may freely and independently rotate and open just like pages of a book attached to a binder. Accordingly, items contained by the first and second pockets 138, 140 are easily and conveniently accessible to users such as aircraft pilots.

The spacing of the hinge-attachment 135 of the interior organizer pockets 130, 132, 134 from the hinge 137 of the organizer flap 122 is approximately equal to or greater than a width of one of the interior organizer pockets 130, 132, 134. Although each of the interior organizer pockets 130, 132, 134 is shown with substantially equal dimensions, this is not necessarily so. One or more of the interior organizer pockets 130, 132, 134 may be larger or smaller than the others. Therefore, the spacing of the hinge-attachment 135 of the interior organizer pockets 130, 132, 134 is generally at least equal to the width of the interior organizer pocket having the greatest width. Spacing the hinge-attachment 135 of the interior organizer pockets 130, 132, 134 a distance of at least the width of the organizer pockets allows the organizer pockets 130, 132, 134 to fully open and rotate without hindrance from other portions of the flight bag 100. Nevertheless, a spacing of the hinge-attachment 135 from the hinge 137 of the organizer flap 122 that is less than the width of the organizer pockets 130, 132, 134 is also contemplated according to some embodiments.

Figure 4:
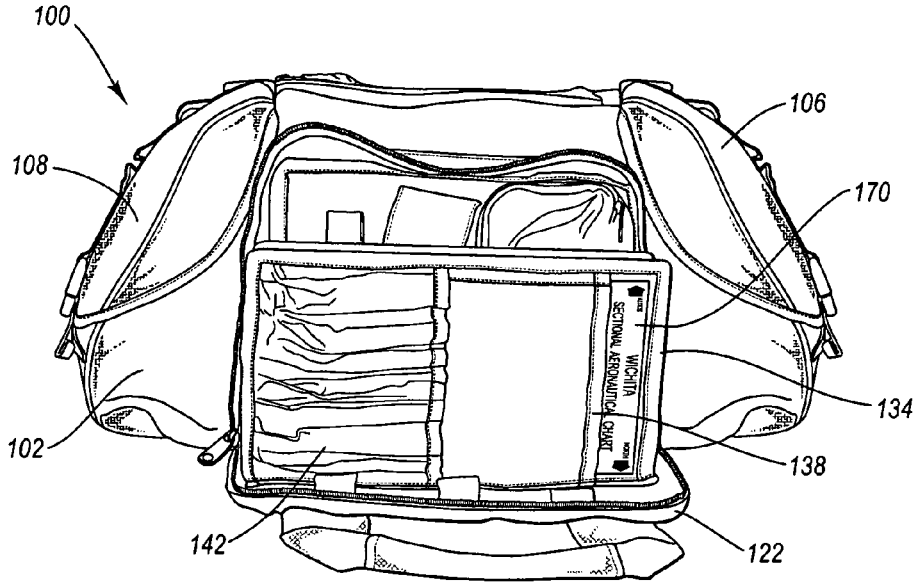
FIG. 4 is a perspective view of the carrying case illustrated in FIGS. 2–3 according to one embodiment of the present invention.
Figure 5:
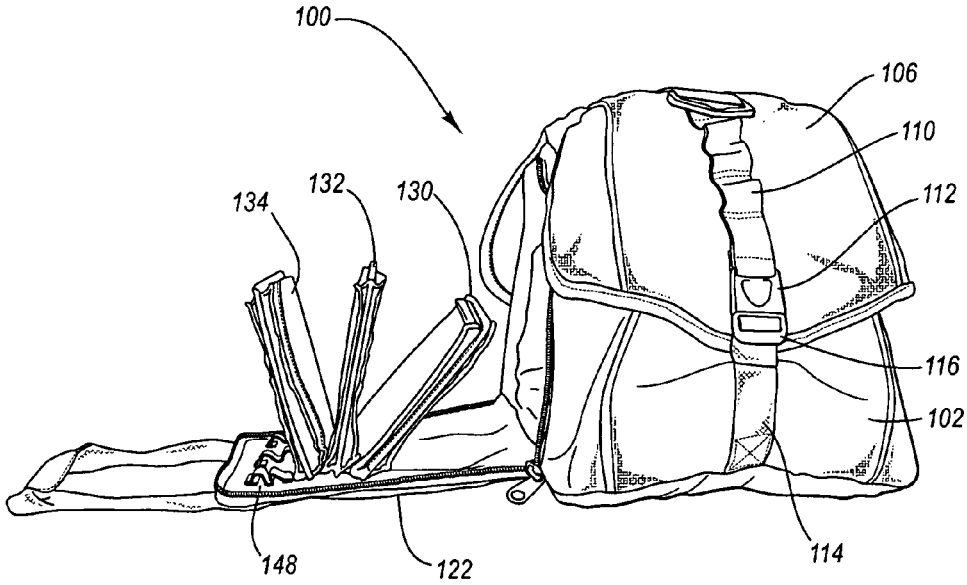
FIG. 5 is a first side view of the carrying case illustrated in FIGS. 2–3 according to one embodiment of the present invention.
Figure 6:
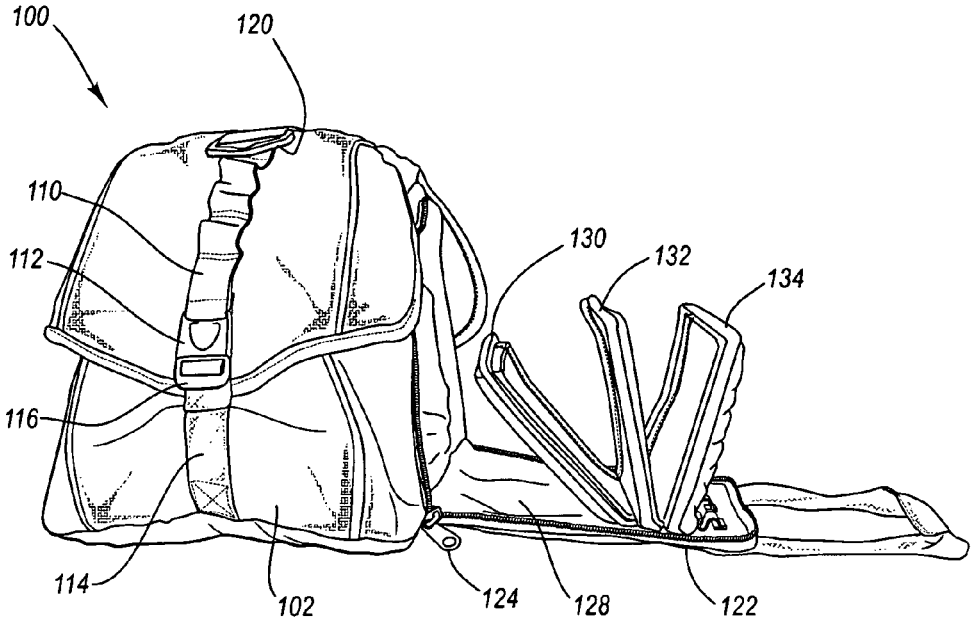
FIG. 6 is a second side view of the carrying case opposite of the view illustrated in FIG. 5 according to one embodiment of the present invention.
Figure 7:
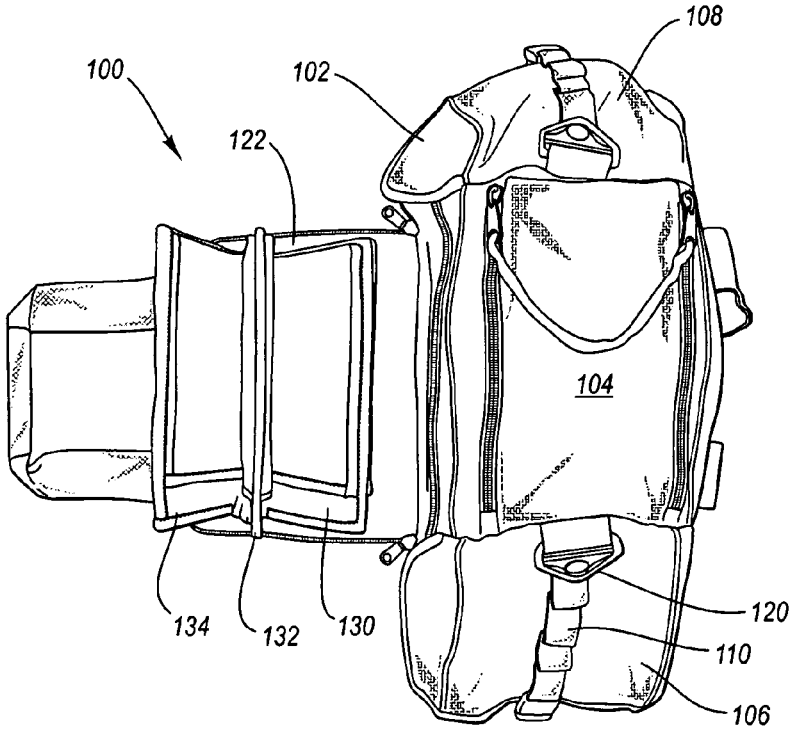
FIG. 7 is a top view of the carrying case illustrated in FIGS. 2–3 according to one embodiment of the present invention.
Figure 8:
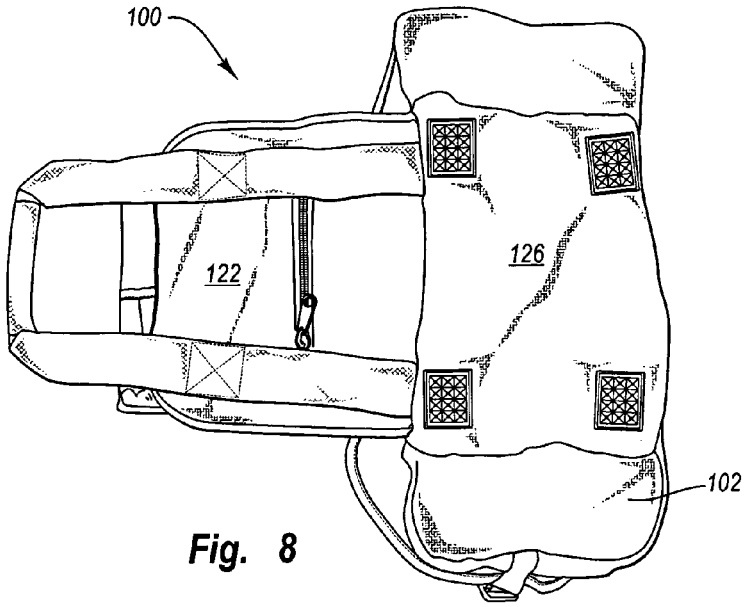
FIG. 8 is a bottom view of the carrying case illustrated in FIGS. 2–3 according to one embodiment of the present invention.

According to the embodiment of FIGS. 2–4, each of the interior organizer pockets 130, 132, 134 is sized to hold a Sectional Aeronautical Chart 170 (FIG. 4). Sectional Aeronautical Charts are readily available from the Federal Aviation Administration and are used regularly by aircraft pilots and others. However, the interior organizer pockets 130, 132, 134 may not extend a full length of the stiff central member 136, such that a title block and other information on the Sectional Aeronautical Chart 170 remains exposed and readable even when fully inserted into one of the interior organizer pockets 130, 132, 134.

Currently, a folded Sectional Aeronautical Chart measures approximately 5 inches wide and 10⅜ inches long, with a thickness of approximately ⅛ of an inch. Therefore, according to some embodiments the stiff central members 136 may comprise rectangular dimensions ranging between approximately 5 and 7 inches in width, and ranging between approximately 9 and 11 inches in length. According to some embodiments, the dimensions of the stiff central members 136 are approximately 6 inches in width and 10 inches in length. It will be understood, of course, that other dimensions may also be used, particularly if the size of Sectional Aeronautical Charts changes. It will also be understood that the dimensions of the organizer flap 122 are large enough to accommodate the full length of the Sectional Aeronautical Charts in order to allow the organizer flap 122 to close as shown in FIG. 1 even if the Charts extend beyond the length dimension of the stiff central members 136. Further, the first and second open pockets 138, 140 may include rectangular dimensions comprising a width ranging between approximately 5 and 6 inches and a length ranging between approximately 8 and 9 inches. According to some embodiments, the width of the first and second open pockets 138, 140 is approximately 5.5 inches, and the length is approximately 8.25 inches. The depth or thickness of the pockets 138, 140 may range between an approximately snug fit with the stiff central member 136 and 0.5 inches according to some embodiments. Other dimensions may also be used according to particular needs.

With the organizer flap 122 open, a number of other features of the flight bag 100 are also exposed. For example, the interior surface 128 may include any number of elastic loops 148 (FIGS. 2–3) to hold batteries, such as "AA" and "AAA" size batteries or others. Further, the organizer flap 122 may house a number of additional internal pockets, such as a third pocket 150 sized to hold a hand-held radio, a GPS (global position system) unit, or other electronic device. Additional loops 152 for holding lights, writing utensils, or other instruments may also be housed in the organizer flap 122 adjacent to the third pocket 150.

Figure 12:
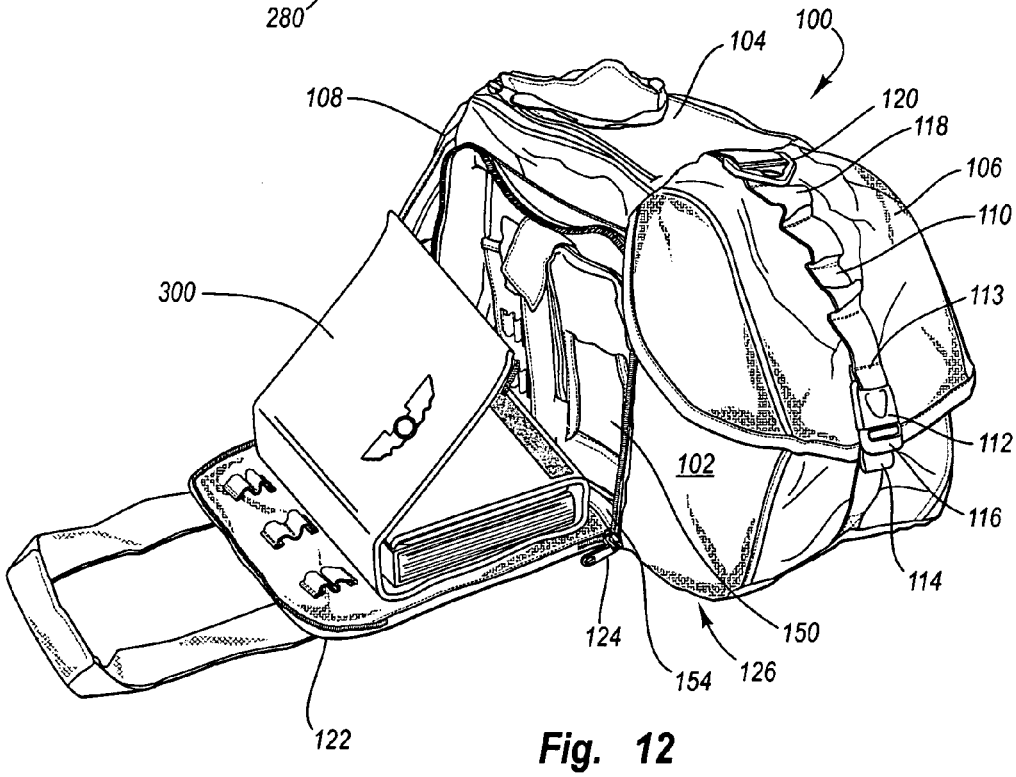
FIG. 12 is a perspective view of an aircraft pilot knee board that may be used with the present invention.
Figure 13:
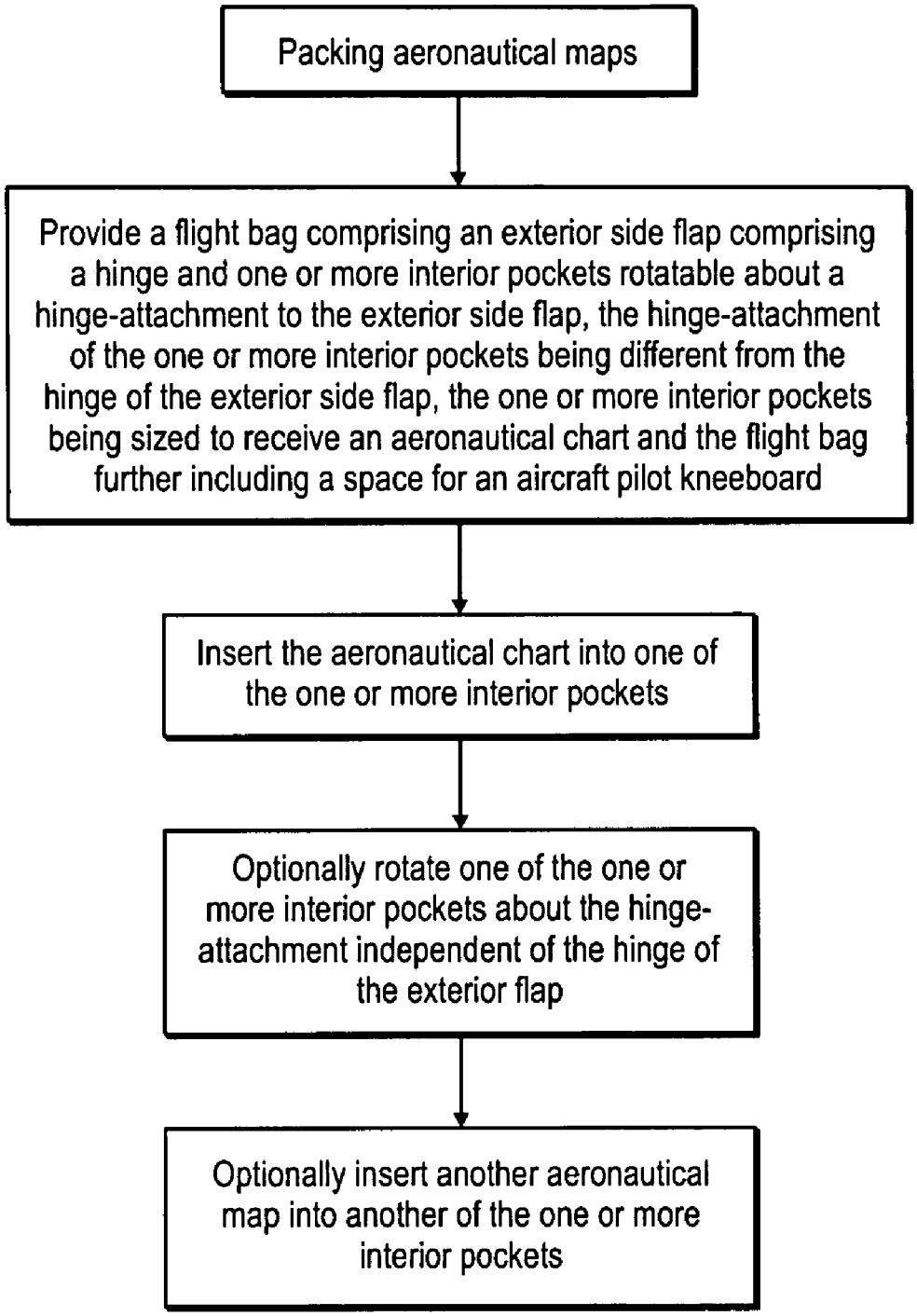
FIG. 13 is a flow chart illustrating a method of packing aeronautical maps according to one aspect of the present invention.

The flight bag 100 also includes a gap 154 (FIGS. 2–3) inside the organizer flap 122 between the base of the interior surface 128 and the central pocket 104. The gap 154 is sized to receive any pilot knee board such as are commonly used in the industry and widely available from a variety of sources. One example of a knee board 300 prior to insertion into the gap 154 is shown in FIG. 12.

FIGS. 5–8 show the principle views of the flight bag 100, with like elements numbered in the same manner as shown in FIGS. 1–4.

The interior organizer pockets or flaps 130, 132, 134 are shown in FIGS. 1–8 permanently fastened at the hinge-attachment to the interior surface 128. However, according to some embodiments, one or all of the interior organizer pockets 130, 132, 134 are individually or collectively removably hinged to the interior surface 128. For example, with reference to FIG. 9, one or more interior organizer pockets 230, 232, 234 are attached to a cylinder 262, and an interior surface 228 comprises a C-shaped channel 264 receptive (at an end 260) of the cylinder 262. Another example is embodied in FIG. 10, which illustrates a hook and loop tape attachment between the interior surface 228 and the one or more interior organizer pockets 230, 232, 234. According to FIG. 10, a first hook and loop tape element 270 is disposed on the interior surface 228, and each of the interior organizer pockets 230, 232, 234 comprises a mating hook and loop tape element 272*a*, 272*b*, 272*c*, respectively. Therefore, each of the interior organizer pockets 230, 232, 234 can be easily removed from the interior surface 228.

Figure 9:
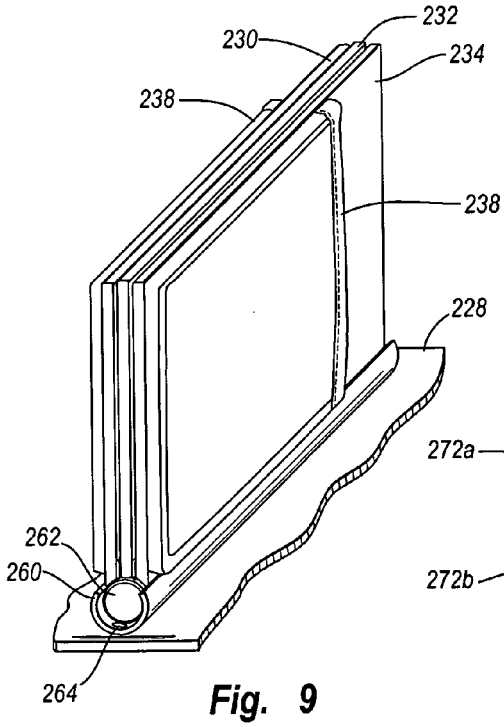
FIG. 9 is a perspective view of the carrying case illustrated in FIGS. 2–3 with removable internal flaps according to one embodiment of the present invention.
Figure 10:
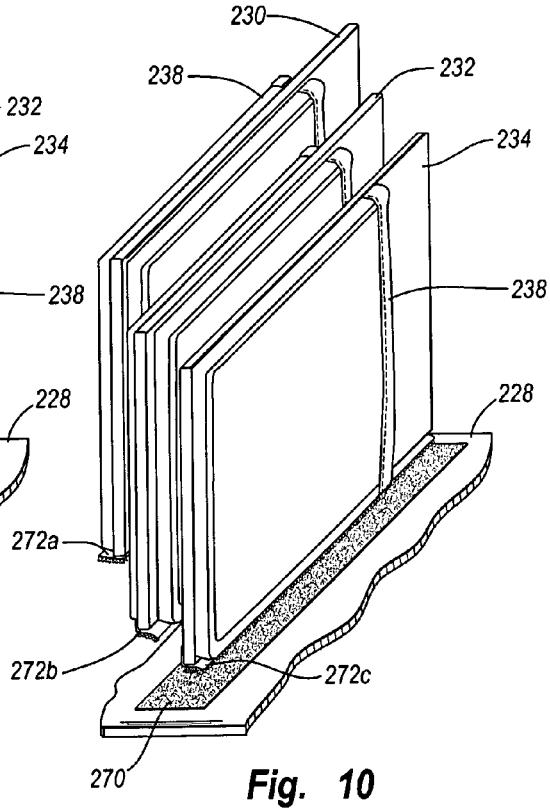
FIG. 10 is a perspective view of the carrying case illustrated in FIGS. 2–3 with another mechanism for removing the internal flaps according to one embodiment of the present invention.
Figure 11:
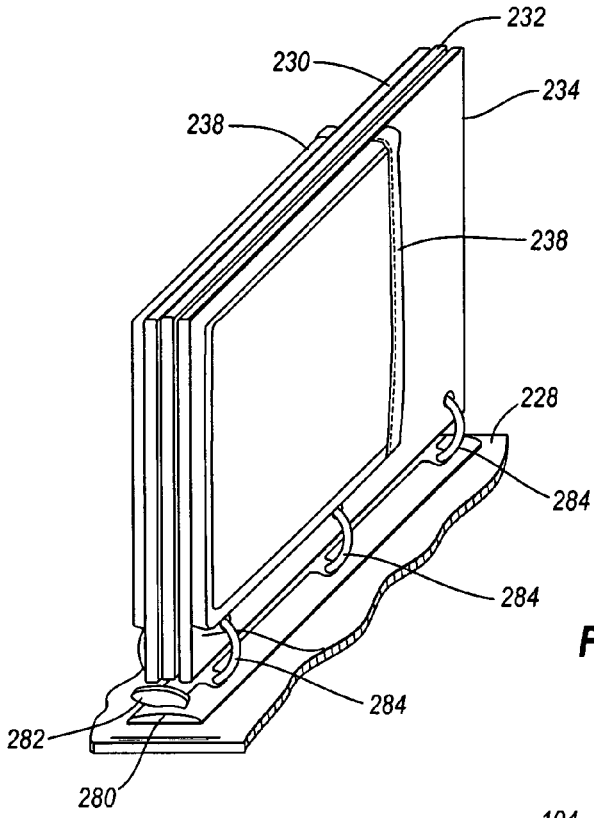
FIG. 11 is a perspective view of the carrying case illustrated in FIGS. 2–3 with another mechanism for removing the internal flaps according to one embodiment of the present invention.

Yet another detachable example is embodied in FIG. 11, which illustrates one or more rings. According to FIG. 11, there are three openable rings 284 connected to the interior surface 228 and looping through each of the interior organizer pockets 230, 232, 234. A lever 282 may be provided to open the rings, and the rings 284 may be attached to the interior surface 228 via a binder 280. Other removable mechanisms may also be employed, as the embodiments of FIGS. 9–11 are merely exemplary.

While this invention has been described with reference to certain specific embodiments and examples, it will be recognized by those skilled in the art that many variations are possible without departing from the scope and spirit of this invention. The invention, as described by the claims, is intended to cover all changes and modifications of the invention which do not depart from the scope of the invention.

What is claimed is:

1. A flight bag, comprising:

an outer shell defining an interior space;

a space for a pilot's knee board;

an organizing flap sized to hold aeronautical charts disposed in the outer shell, the organizing flap comprising:

an interior surface;

a hinge to the outer shell;

one or more organizer pockets hinged to the interior surface of the organizing flap at a spacing from the hinge of the organizing flap.

2. A flight bag according to claim 1, further comprising a plurality of elastic loops attached to the interior surface of the organizing flap and spaced from the hinge further than the one or more organizing pockets.

3. A flight bag according to claim 1, further comprising a central pocket, and wherein the space comprises an internal gap between the base of the outer shell and the central pocket only accessible through the organizing flap.

4. A flight bag according to claim 3, further comprising the pilot's knee board disposed in the internal gap.

5. A flight bag according to claim 1, further comprising an internal pocket housed within the organizing flap sized to hold one or more of: a hand-held radio and a GPS unit.

6. A flight bag according to claim 1 wherein each of the one or more organizer pockets comprises a stiff central member, and a flexible open pocket on each opposing side of the stiff central member.

7. A flight bag according to claim 6 wherein the stiff central member is generally flat and rectangular, and the flexible open pockets extend substantially a full width of the stiff central member but not a full length of the stiff central member.

8. A flight bag according to claim 6 wherein each of the one or more organizer pockets is sized to hold one or more of a Sectional Aeronautical Chart, a Terminal Area Chart, and a World Aeronautical Chart.

9. A flight bag according to claim 1 wherein the one or more organizer pockets is spaced from the hinge a distance approximately equal to or greater than a width of one of the plurality of organizer pockets.

10. A flight bag according to claim 9 wherein the distance is approximately 6 inches.

11. A flight bag according to claim 1 wherein the one or more organizer pockets is removably hinged to the interior surface of the flap.

12. A flight bag according to claim 11 wherein the one or more organizer pockets is removably hinged to the interior surface by one or more of: a ring, a C-channel, and hook and loop tape.

13. A flight bag according to claim 1 wherein organizing flap comprises a zipper such that when the zipper is fully engaged, the organizing flap comprises a portion of the outer shell.

14. A carrying case, comprising:

an outer shell defining an interior space;

an organizing flap disposed in the outer shell, the organizing flap comprising:

an interior surface;

a hinge to the outer shell;

one or more organizer pockets hinged to the interior surface of the organizing flap at a spacing from the hinge of the organizing flap;

wherein each of the one or more organizer pockets comprises a stiff central member, and a flexible open pocket on each opposing side of the stiff central member wherein each of the stiff central members comprises rectangular dimensions comprising a width ranging between approximately 5 and 7 inches and a length ranging between approximately 9 and 11 inches.

15. A carrying case according to claim 14 wherein the width is approximately 6 inches and the length is approximately 10 inches.

16. A carrying case according to claim 15 wherein each of the flexible open pockets comprises rectangular dimensions comprising a width ranging between approximately 5 and 6 inches and a length ranging between approximately 8 and 9 inches.

17. A carrying case according to claim 16 wherein the width of the open pockets is approximately 5.5 inches and the length of the pockets is approximately 8.25 inches.

18. A flight bag, comprising:

an outer shell;

a space for an aircraft pilot knee board disposed in the flight bag;

a closeable side flap comprising one or more interior flaps hinged to the side flap, each of the one or more interior flaps being sized to hold aeronautical charts and being separately rotatable about an attachment to the closeable side flap in a book-like manner.

19. A flight bag according to claim 18, further comprising a hinge between the closeable side flap and the flight bag, wherein the attachment of the one or more interior flaps to the closeable side flap is spaced from the hinge.

20. A flight bag according to claim 18 wherein each of the one or more interior flaps comprise a plate having first and second pockets extending from opposite sides thereof.

21. A flight bag according to claim 20 wherein both the first and second pockets of each of the one or more interior flaps is sized to hold one or more of a Sectional Aeronautical Chart, a Terminal Area Chart, and a World Aeronautical Chart.

22. A flight bag according to claim 21 wherein both the first and second pockets of each of the one or more interior flaps is sized such that a title block of the Sectional Aeronautical Chart is exposed.

23. A flight bag according to claim 18 wherein the one or more interior flaps are removable from the closeable side flap.

24. A flight bag according to claim 18 further comprising a central pocket, first and second side pockets receptive of radio headsets, and wherein the space comprises an interior gap disposed below the central pocket receptive of the aircraft pilot knee board.

25. A flight bag, comprising:

an outer shell;

a closeable side flap comprising one or more interior flaps hinged to the side flap, each of the one or more interior flaps being separately rotatable about an attachment to the closeable side flap in a book-like manner;

wherein each of the one or more interior flaps comprise a plate having first and second pockets extending from opposite sides thereof;

wherein both the first and second pockets of each of the one or more interior flaps ranges between 5 and 6 inches in width, 8 and 9 inches in length, and 0.05 to 0.5 inches in thickness.

26. A flight bag, comprising:

an outer shell;

a closeable side flap comprising one or more interior flaps hinged to the side flap, each of the one or more interior flaps being separately rotatable about an attachment to the closeable side flap in a book-like manner;

wherein each of the one or more interior flaps comprise a plate having first and second pockets extending from opposite sides thereof;

wherein each of the one or more interior flaps is approximately 6 inches wide and 10 inches long.

27. A piece of luggage, comprising:

a flight bag, the flight bag comprising:

a plurality of pockets;

an exterior side flap comprising a hinge;

one or more interior pockets sized to hold aeronautical charts and rotatable about a hinge-attachment to the exterior side flap, the hinge-attachment of the one or more interior pockets being different from the hinge of the exterior side flap.

28. A piece of luggage according to claim 27 wherein each of the one or more interior pockets comprises a stiff center plate with first and second pockets on opposite sides thereof.

29. A piece of luggage according to claim 27 wherein the hinge-attachment of the one or more interior pockets is spaced from the hinge of the exterior side flap by a distance approximately equal to or greater than a width of the one or more interior pockets.

30. A piece of luggage according to claim 27 wherein the external side flap is closeable.

31. A piece of luggage according to claim 30 wherein an external surface of the external side flap comprises a portion of an outer shell when closed.

32. A piece of luggage according to claim 31 wherein the outer shell is flexible.

33. A piece of luggage, comprising:

a plurality of pockets;

an exterior side flap comprising a hinge;

one or more interior pockets rotatable about a hinge-attachment to the exterior side flap, the hinge-attachment of the one or more interior pockets being different from the hinge of the exterior side flap a stiff center plate with first and second pockets on opposite sides thereof;

wherein the stiff center plate comprises dimensions ranging between 5.5 and 6.5 inches in width, and 9.5 and 10.5 inches in length.

34. A piece of luggage according to claim 33 wherein the first and second pockets comprise dimensions ranging between 5 and 6 inches in width and 8 and 9 inches in length.

35. A flight bag, comprising:

an outer shell defining an interior space;

an organizing flap disposed in the outer shell, the organizing flap comprising:

an interior surface;

an organizer flap hinge to secure the organizer flap to the outer shell;

at least one organizer pocket hinged to the interior surface of the organizing flap at a location spaced from the organizing flap hinge, the organizer pocket sized to hold an aeronautical chart;

a space at the organizer flap hinge for receiving an aircraft pilot knee board.

36. A flight bag according to claim 35, wherein the at least one organizer pocket comprises dimensions ranging between 5 and 6 inches in width and 8 and 9 inches in length.

37. A flight bag, comprising:

an outer shell defining an interior space;

an organizing flap disposed in the outer shell, the organizing flap comprising:

an interior surface;

an organizer flap hinge to secure the organizer flap to the outer shell;

at least one organizer pocket sized to hold an aeronautical chart and secured to the interior surface of the organizing flap;

a space at the organizer flap hinge for an aircraft pilot knee board;

wherein the organizer pocket is secured to the interior surface of the organizer flap at a location spaced from a peripheral edge of the organizer flap corresponding to the organizer flap hinge.

38. A flight bag according to claim 37, wherein the at least one organizer pocket comprises dimensions ranging between 5 and 6 inches in width and 8 and 9 inches in length.

39. A flight bag, comprising:

an outer shell defining an interior space;

an organizing flap disposed in the outer shell, the organizing flap comprising:

an interior surface;

an organizer flap hinge to secure the organizer flap to the outer shell;

at least one organizer pocket hingedly secured the interior surface of the organizing flap at a central location on the organizing flap, the at least one organizer pocket sized to hold an aeronautical chart;

a space for an aircraft pilot knee board.

40. A flight bag according to claim 39, wherein the at least one organizer pocket comprises dimensions ranging between 5 and 6 inches in width and 8 and 9 inches in length.

41. A method of packing aeronautical maps, comprising:

providing a flight bag comprising an exterior side flap comprising a hinge and one or more interior pockets rotatable about a hinge-attachment to the exterior side flap, the hinge-attachment of the one or more interior pockets being different from the hinge of the exterior side flap, the one or more interior pockets being sized to receive an aeronautical map and the flight bag further including a space for an aircraft pilot knee board;

inserting the aeronautical map into one of the one or more interior pockets.

42. A method of packing aeronautical maps according to claim 41, further comprising:

rotating one of the one or more interior pockets about the hinge-attachment independent of the hinge of the exterior side flap;

inserting another aeronautical map into another of the one or more interior pockets.

* * * * *